US009074853B2

(12) United States Patent
Kong et al.

(10) Patent No.: US 9,074,853 B2
(45) Date of Patent: Jul. 7, 2015

(54) HIGH-ENERGY LASER SYSTEM INTERCEPTING A TARGET AND METHOD THEREOF

(75) Inventors: Hong Jin Kong, Daejeon (KR); Jae Sung Shin, Daejeon (KR); Sang Woo Park, Daejeon (KR); Kang Sup Shim, Daejeon (KR); Seong Woo Cha, Daejeon (KR)

(73) Assignee: KOREA ADVANCED INSTITUTE OF SCIENCE AND TECHNOLOGY (KR)

( * ) Notice: Subject to any disclaimer, the term of this patent is extended or adjusted under 35 U.S.C. 154(b) by 290 days.

(21) Appl. No.: 13/639,129

(22) PCT Filed: Sep. 10, 2010

(86) PCT No.: PCT/KR2010/006156

§ 371 (c)(1),
(2), (4) Date: Oct. 3, 2012

(87) PCT Pub. No.: WO2011/126184

PCT Pub. Date: Oct. 13, 2011

(65) Prior Publication Data

US 2013/0033695 A1 Feb. 7, 2013

(30) Foreign Application Priority Data

Apr. 6, 2010 (KR) ..... 10-2010-0031187

(51) Int. Cl.
*G01P 3/36* (2006.01)
*F41H 13/00* (2006.01)

(52) U.S. Cl.
CPC ..... *F41H 13/0062* (2013.01)

(58) Field of Classification Search
CPC ..... G01C 15/002; G01S 17/58; G01S 17/50; G01P 3/36; G01P 5/26; G01P 3/366; B82Y 10/00; F26B 3/28
USPC ..... 356/28, 28.5, 3.01–3.15, 4.01–4.1, 356/5.01–5.15
See application file for complete search history.

(56) References Cited

U.S. PATENT DOCUMENTS 4,500,855 A 2/1985 Feinberg
4,573,157 A * 2/1986 O'Meara ..... 372/19
4,734,911 A * 3/1988 Bruesselbach ..... 372/21

(Continued)

FOREIGN PATENT DOCUMENTS

WO 2007129794 11/2007

OTHER PUBLICATIONS

Markov et al. "Nonlinear Optical Phase Conjugation Amplifier for Remote Object Tracking and Characterization", 2007.*

(Continued)

*Primary Examiner* — Luke Ratcliffe
*Assistant Examiner* — Assres H Woldemaryam
(74) *Attorney, Agent, or Firm* — Cantor Colburn LLP

(57) ABSTRACT

A high-energy laser system intercepting a target using a phase conjugate mirror includes a laser oscillator which generates a laser beam irradiated to the target, a light amplifier which receives the laser beam irradiated to and reflected by the target so as to amplify it, a phase conjugate mirror which reflects the amplified laser beam. And the laser beam that is reflected by the phase conjugate mirror is amplified again in the light amplifier, and then irradiated to the target so as to intercept the target.

8 Claims, 3 Drawing Sheets

(56) References Cited

U.S. PATENT DOCUMENTS

| | | | | |
|---|---|---|---|---|
| 4,798,462 | A * | 1/1989 | Byren | 356/139.08 |
| 4,812,639 | A * | 3/1989 | Byren et al. | 250/201.1 |
| 5,020,901 | A * | 6/1991 | de Groot | 356/5.1 |
| 5,198,837 | A * | 3/1993 | Ikshizaka et al. | 347/256 |
| 5,291,263 | A * | 3/1994 | Kong | 356/4.01 |
| 6,961,171 | B2 * | 11/2005 | Byren et al. | 359/333 |
| 8,462,323 | B2 * | 6/2013 | Markov et al. | 356/73 |
| 2009/0060508 | A1 * | 3/2009 | Tanimura et al. | 398/65 |
| 2009/0147238 | A1 * | 6/2009 | Markov et al. | 356/3 |

OTHER PUBLICATIONS

International Search Report—PCT/KR2010/006156 dated May 30, 2011.

* cited by examiner

HIGH-ENERGY LASER SYSTEM INTERCEPTING A TARGET AND METHOD THEREOF

TECHNICAL FIELD

The present invention relates to a high-energy laser system intercepting a target and a method thereof, which irradiates a laser beam to a target in the early stage, amplifies the laser beam scattered from the target using a phase conjugate mirror and an amplifier and then irradiates again the amplified beam to the target by using only passive components, thereby intercepting the target with very high accuracy.

BACKGROUND ART

For military purposes, there has been developed various laser technologies which intercepts a long-range mortar, a missile or the like from the air or ground. Recently, as a part of the MD (missile defense), USA has carried-out a successful experiment with the air borne laser test bed for intercepting a liquid-fueled ballistic missile launched from the ground.

In a conventional apparatus for intercepting a missile or the like using laser, firstly, it was necessary to irradiate a tracking laser beam to the missile and to analyze velocity and height of the missile and atmospheric status with a computer and then irradiate an intercepting laser beam, thereby intercepting the missile.

One of problems in the conventional intercepting apparatus is to form the high energy laser beam which is mainly formed by amplifying and combining multiple laser beams. A technical problem in combining the laser beams is to overcome wave-front distortion of each laser beam. To this end, there has been proposed a new technique using an adaptive optics and a phase conjugate mirror.

Another problem in the intercepting apparatus using the high energy laser beam is to irradiate the high energy laser beam to an exact position so as to intercept a target. At this time, one of important factors is an atmospheric disturbance between the target and the intercepting apparatus.

Since the atmospheric disturbance functions as an optical dispersive medium, the laser beam is distorted and refracted through the atmospheric disturbance, and thus it is not possible to exactly intercept the target. That is, the laser beam may be irradiated to a wrong position which is apart from a target. And also the laser beam wave-front is to be distorted by the atmospheric disturbance and the intensity distribution becomes distributed widely at the target so that the damage on the target becomes very weak. To solve the problems, the adaptive optics is generally used to compensate the wave-front distortion due to the atmospheric disturbance. In the adaptive optics, the wave-front distortion is previously measured by a wave-front sensor so as to actively control a deformable mirror having a piezoelectric actuator, thereby compensating the wave-front.

As described above, since the adaptive optics also compensates the wave-front distortion caused by large amount of heat of a laser gain medium in the laser amplifying process, it is also widely used in a amplifying system for a high energy laser beam.

However, the adaptive optics has some disadvantages in that its response speed is restricted by the piezoelectric actuator, its manufacturing cost is too high, it is too bulky and heavy, and its operation is very complicated. Furthermore, in order to measure and compensate the wave-front distortion using the wave-front sensor and the deformable mirror, the adaptive optics should have a very complicated construction even though it gives incomplete wave front compensation.

In other words, the conventional intercepting apparatus, which has the adaptive optics so as to solve the problem of failing the target interception due to the wave-front distortion and the light refraction when irradiating the high energy laser beam to the target, has a high manufacturing cost and a complicated driving mechanism. Thus, it is difficult to stabilize the apparatus and the response speed is restricted.

DISCLOSURE

Technical Problem

An object of the present invention is to solve the problem of a wave-front distortion caused by an atmospheric disturbance in the conventional high-energy intercepting apparatus. And the present invention provides a high-energy laser system intercepting a target and a method thereof, in which wave-front distortions generated in amplifiers are compensated by a phase conjugate mirror and a wave-front distortion generated by an atmospheric disturbance is also compensated by the phase conjugate mirror.

Another object of the present invention is to provide a high-energy laser system intercepting a target, which can compensate the wave-front distortions generated by the amplifier as well as the atmospheric disturbance, thereby exactly intercepting the target by using only the passive components.

Yet another object of the present invention is to provide a high-energy laser system intercepting a target, which can compensate the wave-front distortion generated by the atmospheric disturbance by using only the passive components, thereby having a low manufacturing cost and a high efficiency.

Yet another object of the present invention is to provide a high-energy laser system intercepting a target and a method thereof, which can exactly intercept the target by considering even the movement of the target during time interval between aiming and intercepting, provided that an n-th harmonic generator and a wedge-shaped glass are additionally equipped.

Technical Solution

To achieve the object of the present invention, the present invention provides a high-energy laser system intercepting a target, including a laser oscillator which generates a laser beam to be irradiated to the target; a light amplifier which receives the laser beam irradiated to and reflected by the target so as to amplify it; a phase conjugate mirror which reflects the amplified laser beam with phase conjugation, wherein the laser beam, that is reflected by the phase conjugate mirror, is amplified again in the light amplifier, and then irradiated to the target so as to intercept the target.

Preferably, the high-energy laser system further includes a polarizing beam splitter which transmits or reflects the laser beam so as to irradiate the target according to whether the laser beam is P-polarized light or S-polarized light; and a polarization converter which is disposed at a front end of the polarizing beam splitter so as to convert an initial linearly polarized light transmitted through or reflected by the polarizing beam splitter into a circularly polarized light and also convert the laser beam reflected by the target into a laser beam which is linearly polarized perpendicular to the initial linearly polarized light.

Preferably, the polarizing beam splitter functions to reflect or transmit the laser beam reflected by the target and passed through the polarization converter so that the laser beam is incident to the light amplifier.

Preferably, the high-energy laser system further includes a light irradiating device which is disposed at a front end of the high-energy laser system so as to irradiate the laser beam; a target track sensor which measures a position and a speed of the target and generates a control signal in real time; and an aiming mirror which is controlled by the control signal of the target track sensor so as to aim the target.

Preferably, the sunlight reflected from the target is collected by the light irradiating device and then incident to the target track sensor, and the target track sensor determines the position and speed of the target from the incident sunlight so as to control the aiming mirror and thus aim the target, and the laser beam generated from the laser oscillator is irradiated to the target through the aiming mirror and light irradiating device, reflected from the target and then collimated in the light irradiating device. And the collimated laser beam passing the aiming mirror and amplified in the light amplifier is reflected by the phase conjugate mirror, amplified again in the light amplifier, passes the aiming mirror and passed through the light irradiating device so as to be irradiated to the target, thereby intercepting the target.

Preferably, the high-energy laser system further includes an n-th order harmonic generator which is disposed between the light amplifier and the target so as to convert the frequency of the laser beam reflected by phase conjugate mirror and amplified; and a wedge-shaped glass plate which is disposed at a front side of the n-th order harmonic generator so as to change an optical path of the laser beam.

Preferably, the optical path of the laser beam is changed in the wedge-shaped glass plate by controlling a value of N of the n-th order harmonic generator and an angle of β of the wedge-shaped glass plate, thereby intercepting the target.

Further, the present invention provides a high-energy laser system intercepting a target, which includes a laser oscillator which generates a laser beam and irradiates it to the target; and a light amplifier having an SBS-PCM by which a laser beam irradiated to and reflected from the target is amplified and reflected with phase conjugation. The laser beam generated from the laser oscillator is irradiated to the target and incident to the light amplifier using the SBS-PCM. Then, the high energy laser beam that is reflected with phase conjugation from a light amplifier using the SBS-PCM is irradiated again to the target, thereby intercepting the target.

Preferably, the high-energy laser system further includes a polarizing beam splitter which transmits or reflects the laser beam so as to be irradiate to the target according to whether the laser beam is P-polarized light or S-polarized light; and a polarization converter which is disposed at a front end of the polarizing beam splitter so as to convert an initial linearly polarized light transmitted through or reflected by the polarizing beam splitter into a circularly polarized light and also convert the laser beam reflected by the target into a laser beam having a linearly polarized light perpendicular to the initial linearly polarized light. Herein, the polarizing beam splitter functions to reflect or transmit the laser beam reflected by the target and passed through the polarization converter so that the laser beam is incident to the light amplifier.

Preferably, the high-energy laser system further includes a light irradiating device which is disposed at a front end of the high-energy laser system so as to irradiate the laser beam; a target track sensor which measures a position and a speed of the target and generates a control signal in real time; and an aiming mirror which is controlled by the control signal of the target track sensor so as to aim the target.

Preferably, the sunlight reflected from the target is collected by the light irradiating device and then incident to the target track sensor, and the target track sensor determines the positions and speed of the target from the incident sunlight so as to control the aiming mirror and thus aim the target, and the laser beam generated from the laser oscillator is irradiated to the target through the aiming mirror and light irradiating device, reflected from the target and then collimated in the light irradiating device, and the collimated laser beam passing the aiming mirror is amplified and reflected with phase conjugation in the light amplifier using the SBS-PCM, passes the aiming mirror and then passed through the light irradiating device so as to be irradiated to the target, thereby intercepting the target.

Preferably, the high-energy laser system further includes an n-th order harmonic generator which is disposed between the light amplifier and the target so as to convert the frequency of the reflected with phase conjugation and amplified laser beam; and a wedge-shaped glass plate which is disposed at a front side of the n-th order harmonic generator so as to change an optical path of the laser beam.

Preferably, the optical path of the laser beam is changed in the wedge-shaped glass plate by controlling a value of N of the n-th order harmonic generator and an angle of β of the wedge-shaped glass plate, thereby intercepting the target.

Further, the present invention provides a method of intercepting a target with a high energy laser system, includes irradiating a laser beam from a laser oscillator onto the target; first amplification of amplifying the laser beam, reflected from the target after being irradiated to the target, in a light amplifier; receiving and reflecting the amplified laser beam by a phase conjugate mirror; second-amplifying the phase conjugated laser beam in the light amplifier; and irradiating the amplified high energy laser beam to the target by using only passive components and intercepting the target.

Further, the present invention provides a method of intercepting a target with a high energy laser system includes irradiating a laser beam from a laser oscillator to the target; amplifying and reflecting the laser beam with phase conjugation, reflected from the target after being irradiated to the target, in a light amplifier using SBS-PCM after the laser beam irradiated to the target is reflected; and irradiating the reflected high energy laser beam with phase conjugation to the target by using only passive components and intercepting the target.

Preferably, the method further includes, the irradiating of the reflected high energy laser beam with phase conjugation to the target by using only passive components and the intercepting of the target, converting a frequency of the reflected high energy laser beam with phase conjugation using a frequency converter; changing an optical path of the high energy laser beam having the converted frequency using a wedge-shaped glass plate; and irradiating the laser light along the changed optical path to the moved target and intercepting the target.

Advantageous Effects

As described above, since the high-energy laser system intercepting the target according to the present invention amplifies and reflects the laser beam irradiated to the target by phase conjugate mirror, it is possible to compensate the wavefront distortions generated by the amplifier as well as the atmospheric disturbance, thereby exactly intercepting the target by using only passive components.

Further, since the high-energy laser system intercepting the target according to the present invention uses the passive component, it does not require any special technique, and also since it does not use a piezoelectric actuator or the like, it is not restricted in the reaction speed.

Furthermore, since the high-energy laser system intercepting the target according to the present invention has a simpler optics than the adaptive optics in the conventional intercepting apparatus, the manufacturing cost is low. And when considering general properties of the optics which is influenced by minute vibration, it is possible to embody more stabilized apparatus by the present invention.

Therefore, when the present invention is applied to a military laser system intercepting a target, it is expected to increase precision and efficiency of the target interception.

DESCRIPTION OF DRAWINGS

The above and other objects, features and advantages of the present invention will become apparent from the following description of preferred embodiments given in conjunction with the accompanying drawings, in which.

DETAILED DESCRIPTION OF MAIN ELEMENTS

Figure 1:
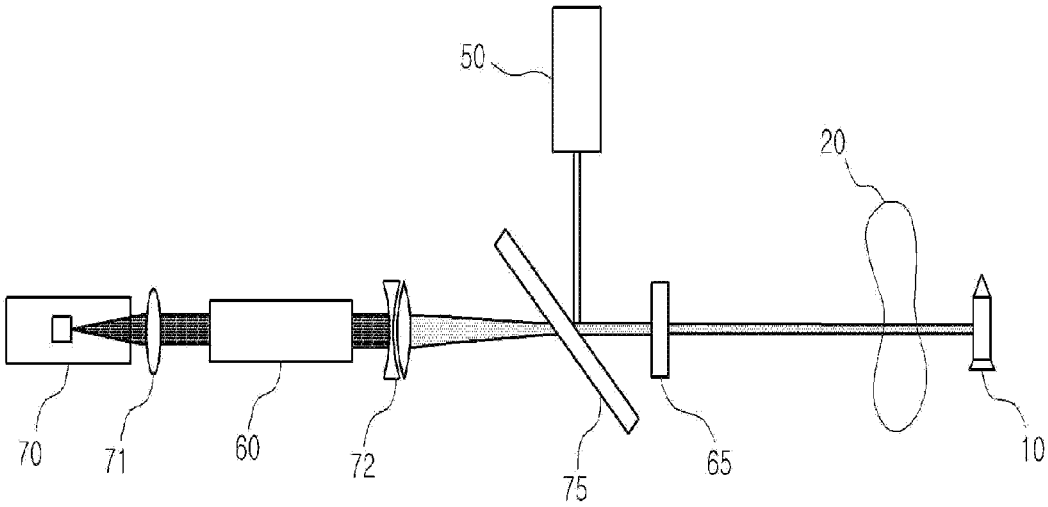
FIG. 1 is a schematic view of a high-energy laser system intercepting a target using a phase conjugate mirror in accordance with an embodiment of the present invention.

10, 110, 210: initial target position
15, 215: moved target position
20, 120, 220: atmospheric disturbance
130, 230: telescope 135, 235: aiming mirror
140, 240: target track sensor
145, 245: reflecting mirror
50, 150, 250: laser oscillator
155, 255: beam splitter 60: light amplifier
160, 260: serial light amplifier
65: polarization converter
165, 265: quarter wave plate
70, 170, 270: phase conjugate mirror
71, 72: irradiating lens
75, 175, 275: polarizing beam splitter
77: light amplifier using SBS-PCM
180, 280: irradiated laser beam scattered from target
181, 281: laser beam irradiated to target
182, 282: sunlight reflected from target
183, 283: high energy laser beam intercepting target
185, 285: reflecting mirror
90, 290: n-th order harmonic generator
95, 295: wedge-shaped glass plate
300: wedge-shaped glass plate having an angle $\beta$
320: laser beam having a frequency $\omega$
330: laser beam of a frequency $\omega$ refracted by wedge-shaped glass plate
340: laser beam having a frequency $n\omega$
350: laser beam of a frequency $n\omega$ refracted by wedge-shaped glass plate

BEST MODE

The present invention relates to a high energy laser system intercepting a target, which irradiates a laser beam to the target in the early stage, amplifies and reflects light scattered from the target using a phase conjugate mirror and an amplifier, and then intercepts the target. In the present invention, the phase conjugate mirror compensates a wave-front distortion occurred by an atmospheric disturbance as well as a wave-front distortion occurred in the amplifier, and also returns the light along an optical path of the scattered light, thereby exactly intercepting the target by using only passive components.

The phase conjugate mirror functions to reverse and reflect an incident laser beam. A wave generated from the phase conjugate mirror is called a phase conjugate wave. If the phase conjugate wave is passed again through a wave-front distorting medium, the wave is compensated into an initial waveform. Unlike an adaptive optics which actively compensates the wave-front distortion, the phase conjugate mirror is a passive component, and thus a special technique for driving it is not needed, whereby the phase conjugate mirror has a low manufacturing cost. Further, since it does not employ a piezoelectric actuator, its reaction speed is not restricted.

Hereinafter, the embodiments of the present invention will be described in detail with reference to accompanying drawings.

FIG. 1 shows a high-energy laser system intercepting a target according to an embodiment of the present invention. According to the embodiment of the present invention of FIG. 1, first of all, a laser beam is irradiated from a laser oscillator 50 to a target 10, which is spaced apart by a long distance, so as to intercept the target. Herein, the laser beam generated from the laser oscillator 50 is reflected by a polarizing beam splitter 75, irradiated to the target 10 and then scattered, and a part of the laser beam is passed again through the polarizing beam splitter 75.

At this time, a polarization converter 65 like a quarter-wave plate may be disposed at a front side of the polarizing beam splitter 75 so as to efficiently propagate the laser beam.

The reflected laser beam is amplified by a light amplifier 60, reflected as the phase conjugate wave by a phase conjugate mirror 70, and then amplified again in the light amplifier 60, thereby forming a high energy laser beam that hits and intercepts the target.

Herein, the phase conjugate mirror 70 functions so that the laser beam scattered on the target 10 is exactly returned to the target. While the laser beam scattered on the target 10 is passed through an atmospheric disturbance 20 in the air, a wave-front distortion is occurred, and also when amplifying the laser beam, the wave-front of the laser beam is further distorted while being passed through the light amplifier 60. In case that a typical mirror is used instead of the phase conjugate mirror 70, the laser beam amplified is not exactly irradiated to the target by the wave-front distortions, and an optical path thereof is changed. The phase conjugate mirror 70 generates the phase conjugate wave, and thus the wave-front distortions, which occur when the laser beam is passed through the light amplifier 60 and the atmospheric disturbance 20, are compensated. And then the phase conjugate laser beam is returned along an optical path incident from the target, thereby exactly intercepting the target 10 by using only passive components.

In order to increase the efficiency of the target interception, a light irradiating device such as a telescope and a lens may be provided. In this case, a detailed structure thereof may be sufficiently designed by those skilled in the art.

Herein, instead of a construction that the amplifier and the phase conjugate mirror are disposed in order, a light amplifier 77 using an SBS-PCM (Stimulated Brillouin Scattering Phase Conjugate Mirror) may be used.

Figure 2:
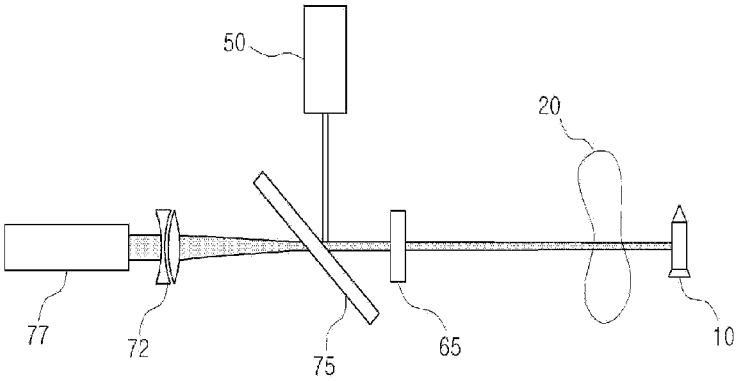
FIG. 2 is a schematic view of a high-energy laser system intercepting a target in accordance with another embodiment of the present invention.

FIG. 2 shows a high-energy laser system intercepting a target, which is provided with the light amplifier 77 using the SBS-PCM.

The light amplifier 77 using the SBS-PCM is described in Korean Patent No. 0784838 (Light amplifier using apparatus for phase stabilization of the stimulated brillouin scattering phase conjugate mirror), and thus its detailed description will be omitted. Hereinafter, the construction of the light amplifier 77 using the SBS-PCM is based on this patent.

In the light amplifier 77 using the SBS-PCM, the laser beam is reflected by the SBS-PCM generating the phase conjugate wave, and thus the wave-front distortion occurred by the atmospheric disturbance is compensated and then scattered on a target, and also the scattered light is returned along an incident optical path, thereby exactly intercepting the target by using only passive components.

The laser system intercepting the target, which includes the light amplifier 77 using the SBS-PCM, has the same construction thereof and action of the laser beam as those in the embodiment of FIG. 1, except the construction of the light amplifier and the phase conjugate mirror.

Meanwhile, in FIG. 1, the laser beam generated from the laser oscillator 31 is reflected by the polarizing beam splitter 75 and irradiated to the target. However, the high energy intercepting apparatus may be constructed so that the laser beam generated from the laser oscillator 31 is passed through the polarizing beam splitter 75 and irradiated to the target, and the laser beam reflected from the target is reflected by the polarizing beam splitter 75 and then introduced into the amplifier.

Such simple change of the optical construction belongs to the scope of the present invention, those skilled in the art that various changes and modifications of the optical devices may be made easily.

Although the polarizing beam splitter 75 is used in the embodiment of FIG. 1, it is not essential to use it. Other suitable optical constructions may be used so that the optical path of the laser beam reflected from the target is not interfered.

Hereinafter, another embodiment of the present invention will be described with reference to FIG. 4.

Figure 4:
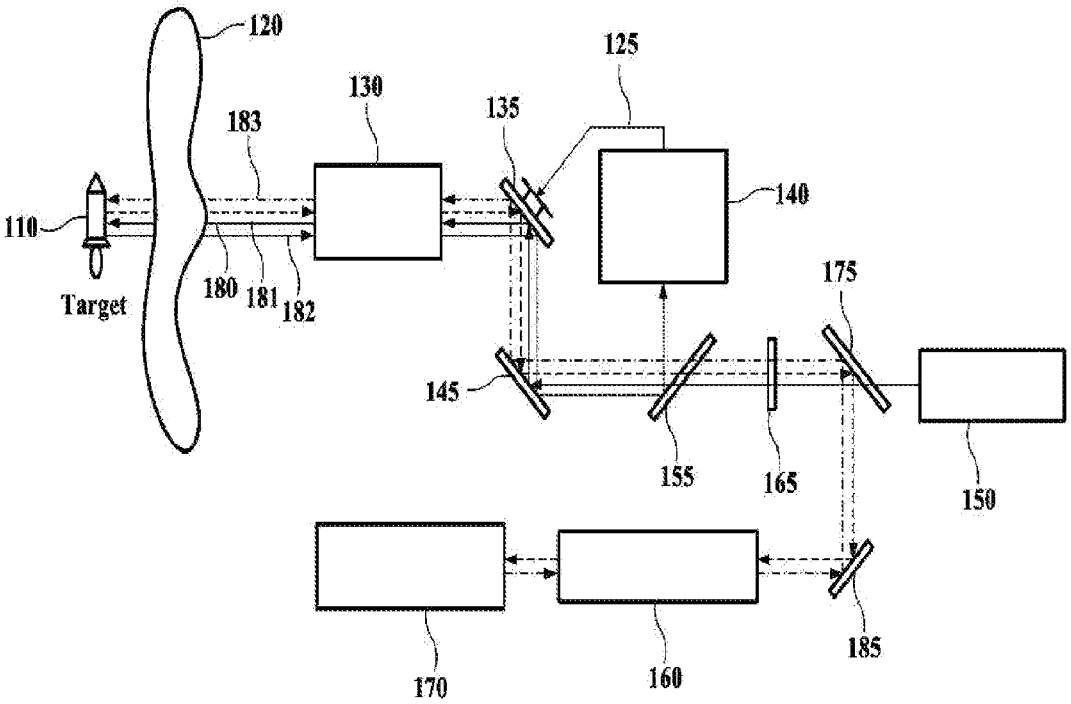
FIG. 4 is a schematic view of a laser system intercepting a target, and an optical path of a laser beam irradiated from the laser system in accordance with an embodiment of the present invention.

FIG. 4 shows a high energy laser system intercepting a target according to another embodiment of the present invention. Sunlight 182 reflected from a target at the early stage is passed through a telescope 130, reflected by a beam splitter 155 and then incident to a target track sensor 140. Herein, the telescope 130 functions as a light irradiating device, and various types of light irradiating devices may be used. The target track sensor 140 determines a position and a velocity of the target from the incident sunlight, and outputs a control signal so as to continuously change a direction of an aiming mirror 135, thereby aiming the target in real time.

If the aiming operation is completed, the laser oscillator 150 irradiates a laser beam to the target. The irradiated laser beam having P-polarized light is transmitted through a polarizing beam splitter 175, and passed through a quarter-wave plate 165, a 45로 angled mirror 145 and an aiming mirror 135, and then irradiated to the target through the telescope 130. The laser beam 181 irradiated to the target is scattered on the target and then spread all around. A part 180 of the scattered light is collected at the side of the telescope 130 and then converted into S-polarized light while being passed again through the quarter-wave plate 165.

The laser beam of the S-polarized light is reflected by the polarizing beam splitter 175, and amplified while being passed through a serial light amplifier 160, and then reflected by the phase conjugate mirror 170. The laser beam reflected by the phase conjugate mirror 170 is amplified into a high energy laser beam, while being one more passed through the serial light amplifier 160. The amplified high energy laser beam is reflected by the polarizing beam splitter 175 and then irradiated again to the target by the telescope 130. The phase conjugate mirror 170 functions that the laser beam scattered on the target is exactly returned to the target by using only passive components.

The function of the phase conjugate mirror, which compensates the wave-front distortion occurred by the atmospheric disturbance, is the same as that in the above embodiment, and thus its description will be omitted.

Herein, instead of the construction that the serial light amplifier 160 and the phase conjugate mirror are coupled in order, the light amplifier using the SBS-PCM may be used.

Meanwhile, yet another embodiment of the present invention relates to a laser system intercepting a target, which is useful to intercept the target that is relatively far away and has a high speed. Hereinafter, the laser system intercepting the target according to the embodiment of the present invention will be described with reference to FIGS. 3 and 5.

After the laser oscillator 150 irradiates the laser beam to the target, the laser beam passes two times a distance L between the target and the laser system until intercepting the target, and thus a time period t until the target interception may be expressed as follows:

$$t=2L/c$$

Assuming that the distance L is 100 km, t is ⅔ ms because c is 3×108 m/s. If the target is moved at a speed of about 330 m/s corresponding to the velocity of sound, a moved distance of the target during a time period t is 22 cm. Assuming that a size of the target is 1 m that is larger than the moved distance of 22 cm, there is no problem in intercepting the target.

However, assuming that the target is moved at a speed of 1650 m/s that is five times as much as the velocity of sound, and L is 200 km, the moved distance of the target during a time period t of 4/3 ms is 2.2 m. In this case, if a size of the target is 1 m, the moved distance of the target is larger than the size of 1 m, and thus the laser beam can not intercept the target.

Figure 3:
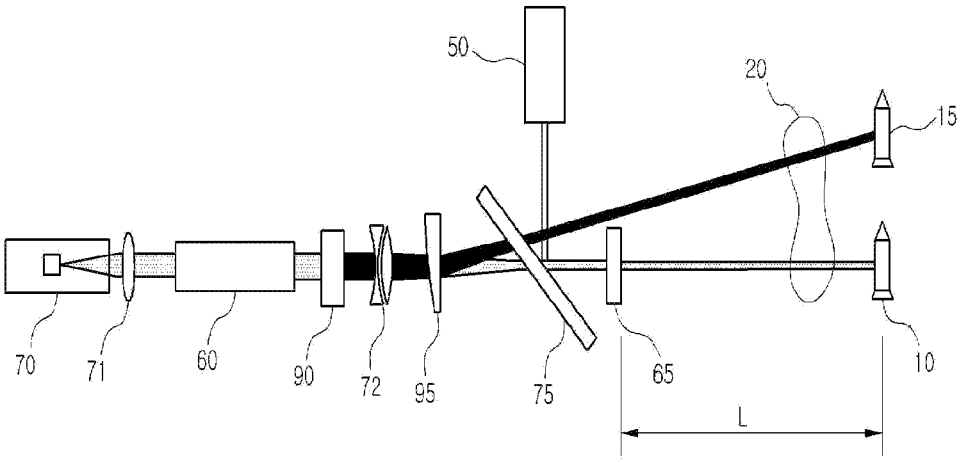
FIG. 3 is a schematic view of a high-energy laser system intercepting a flying target in accordance with the present invention.
Figure 5:
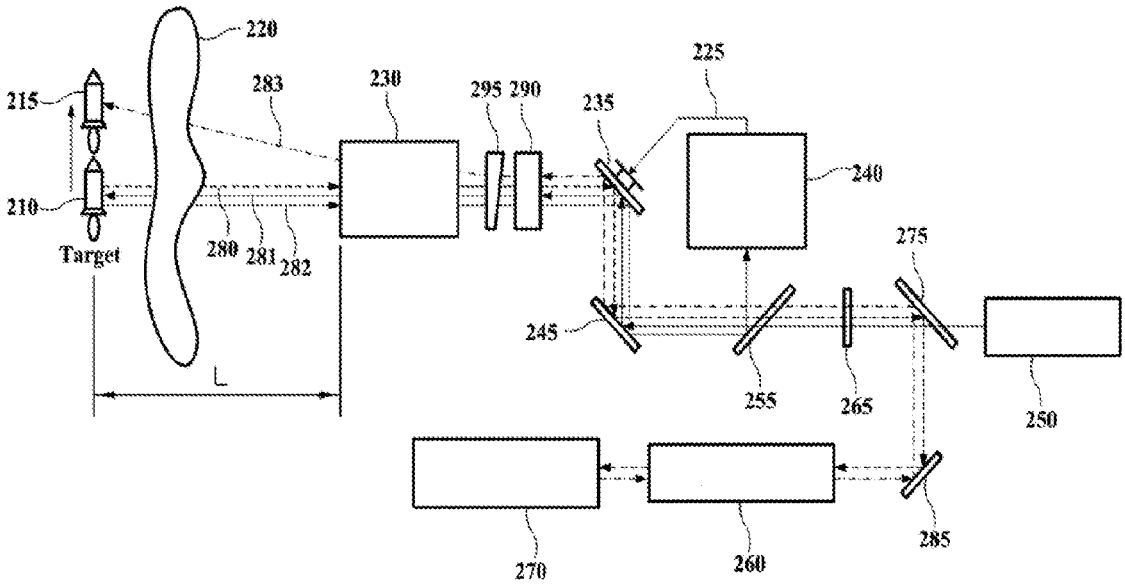
FIG. 5 is a schematic view of a high-energy laser system intercepting a flying target, which includes a wedge-shaped glass plate and an n-th order harmonic generator in accordance with the present invention.

Therefore, in order to intercept a target which is moved at a high speed or far away, an additional device is needed. A preferred embodiment of the present invention is shown in FIGS. 3 and 5. In the embodiment of FIG. 5, a wedge-shaped glass plate 295 and an n-th order harmonic generator 290 are additionally provided at the optical path between the telescope 230 and the aiming mirror 235 in FIG. 4. Some parts of the laser system of FIG. 5 are the same as those in the embodiment of FIG. 4, and the description thereof will be omitted.

In the embodiment, when the laser beam irradiated and scattered on the target is amplified, reflected and then returned again to the target, an optical frequency ω is converted into nω while the laser beam is passed through the n-th order harmonic generator 290. While the laser beam having the optical frequency nω is passed through the wedge-shaped glass plate 295, an optical path thereof is changed so as to compensate the moved distance of the target. This principle uses the difference of refractive index of the glass with respect to the laser beam having the frequency ω and the laser beam having the frequency nω.

Figure 6:
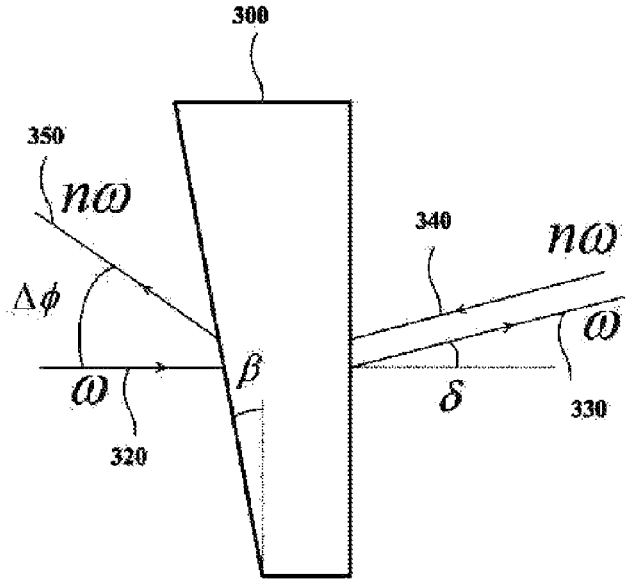
FIG. 6 is a view showing an angular change of an n-th order harmonic wave in case that a first harmonic wave is reflected by a phase conjugate mirror after passing through the wedge-shaped glass plate and then passed through the n-th order harmonic generator so as to be converted into the n-th order harmonic wave, and then the n-th order harmonic wave is again passed through the wedge-shaped glass plate.

FIG. 6 shows the principle in detail. Referring to FIG. 6, when the laser beam having the frequency ω is passed through a wedge-shaped glass plate 300 having an angle β, the laser beam is refracted at an angle of δ by the law of refraction. If the refracted beam 330 is reflected by the phase conjugate mirror, the reflected beam 330 is returned along an initial optical path of the refracted beam 330. In case that the reflected laser beam is converted into the laser beam having the frequency nω by the n-th order harmonic generator, when the reflected laser beam is passed again through the wedge-shape glass plate 300, it does not pass the optical path of the laser beam having the frequency ω, but passes an optical path having an angular difference of □Φ because of the difference in the refractive index of the glass with respect to each frequency.

In FIGS. 3 and 5, assuming that a target, which is spaced apart in a distance L and has a speed V, is moved in a distance d for a time period t, a value n of the n-th order harmonic generator and an angle β of the wedge-shaped glass plate may be selected so as to satisfy a following equation.

$$d=vt=\square\Phi L$$

Therefore, by using such principle, it is possible to correct the optical path of the laser beam reflected by the phase conjugate mirror according to a speed and a distance of the moving target, thereby exactly intercepting the target.

A method of intercepting a target with a high energy laser system according to another embodiment of the present invention includes irradiating a laser beam from a laser oscillator 50 to the target 50; collimating part of laser beam reflected by the target 50 and amplifying the reflected and collimated laser beam in a light amplifier; receiving and reflecting the amplified laser beam by a phase conjugate mirror; amplifying again the reflected laser beam by the phase conjugate mirror in the light amplifier; and irradiating the amplified high energy laser beam to the target and intercepting the target.

According to yet another embodiment of the present invention, a method of intercepting a target with a high energy laser system includes irradiating a laser beam from a laser oscillator 50 to the target 50; collimating part of laser beam reflected by the target 50, and amplifying and reflecting the collimated laser beam with the phase conjugation in a light amplifier 77 using SBS-PCM (Stimulated Brillouin Scattering Phase Conjugate Mirror); and irradiating the amplified high energy laser beam to the target and intercepting the target by using only passive components.

In case that the target is moved at a high speed and relatively far away, the above-mentioned methods of intercepting the target may further include converting a frequency of the laser beam and changing an optical path of the laser beam.

According to yet another embodiment of the present invention, a method of intercepting a target with a high energy laser system includes irradiating a laser beam from a laser oscillator 50 to the target 50; collimating part of laser beam reflected by the target 50 and amplifying the collimated laser beam in a light amplifier; receiving and reflecting the amplified laser beam by a phase conjugate mirror; amplifying again the reflected laser beam with phase conjugation in the light amplifier; converting a frequency of the amplified high energy laser beam using a frequency converter like an n-th order harmonic generator 90; changing an optical path of the laser beam having the converted frequency using a wedge-shaped glass plate; and irradiating the amplified high energy laser beam to the target along the changed optical path and intercepting the target by using only passive components.

The present application contains subject matter related to Korean Patent Application No. 2010-0031187, filed in the Korean Intellectual Property Office on Apr. 6, 2010, the entire contents of which is incorporated herein by reference.

While the present invention has been described with respect to the specific embodiments, it will be apparent to those skilled in the art that various changes and modifications may be made without departing from the spirit and scope of the invention as defined in the following claims.

INDUSTRIAL APPLICABILITY

According to the present invention, in the high-energy laser system intercepting the target, as described above, since the laser beam irradiated to and then scattered from the target is amplified and reflected with phase conjugation, it is possible to compensate the wave-front distortions generated by the amplifier as well as the atmospheric disturbance, thereby exactly intercepting the target by using only passive components. Further, since the high-energy laser system intercepting the target according to the present invention uses the passive component, it does not require any special technique, and also since it does not use a piezoelectric actuator and the like, it is not restricted in its reaction speed.

Furthermore, since the high-energy laser system intercepting the target according to the present invention has a simpler optics system than the adaptive optics in the conventional intercepting apparatus, the manufacturing cost is low. And when considering properties of the optics system which is influenced by minute vibration, it is possible to embody more stabilized apparatus.

Therefore, when the present invention is applied to a military laser system intercepting a target, it is expected to increase precision and efficiency of the target interception.

The invention claimed is:

1. A high-energy laser system intercepting a target, comprising:

a laser oscillator which generates a laser beam to be irradiated to the target;

a light amplifier which receives the laser beam irradiated to and reflected by the target so as to amplify the laser beam;

a phase conjugate mirror which reflects the laser beam amplified by the light amplifier, wherein the laser beam that is reflected by the phase conjugate mirror is amplified again in the light amplifier, and then irradiated to the target so as to intercept the target;

an n-th order harmonic generator which is disposed between the light amplifier and the target so as to convert the frequency of the reflected and amplified laser beam; and a wedge-shaped glass plate which is disposed at a front side of the n-th order harmonic generator so as to change an optical path of the laser beam, wherein the optical path of the laser beam is changed in the wedge-shaped glass plate by controlling a value n of the n-th order harmonic generator and an angle β of the wedge-shaped glass plate, thereby intercepting the target.

2. The high-energy laser system of claim 1, further comprising:

a polarizing beam splitter which transmits or reflects the laser beam to irradiate to the target according to whether the laser beam is P-polarized light or S-polarized light; and a polarization converter which is disposed at a front end of the polarizing beam splitter so as to convert an initial linearly polarized light transmitted through or reflected by the polarizing beam splitter into a circularly polarized light and also convert the laser beam reflected by the target into a laser beam having a linearly polarized light perpendicular to the initial linearly polarized light, wherein the polarizing beam splitter functions to reflect or transmit the laser beam reflected by the target and passed through the polarization converter so that the laser beam is incident to the light amplifier.

3. The high-energy laser system of claim 2, further comprising:

a light irradiating device which is disposed at a front end of the high-energy laser system so as to irradiate the laser beam;

a target track sensor which measures position and speed of the target and generates a control signal in real time; and an aiming mirror which is controlled by the control signal of the target track sensor so as to aim the target, wherein sunlight reflected from the target is collected by the light irradiating device and then incident to the target track sensor, and the target track sensor determines the position and speed of the target from the incident sunlight so as to control the aiming mirror and thus aim the target, and the laser beam generated from the laser oscillator is irradiated to the target by the aiming mirror and light irradiating device, reflected from the target and then collimated in the light irradiating device, and the collimated laser beam passing the aiming mirror and amplified in the light amplifier is reflected by the phase conjugate mirror, amplified in the light amplifier, passes the aiming mirror and passed through the light irradiating device so as to be irradiated to the target, thereby intercepting the target.

4. A high-energy laser system intercepting a target, which comprises a laser oscillator which generates a laser beam and irradiates the laser beam to the target; and a light amplifier using a Stimulated Brillouin Scattering Phase Conjugate Mirror (SBS-PCM) by which the laser beam irradiated to and reflected from the target is amplified and reflected with phase conjugation, wherein the laser beam that is reflected with phase conjugation from the light amplifier using SBS-PCM is irradiated again to the target, thereby intercepting the target;

an n-th order harmonic generator which is disposed between the light amplifier and the target so as to convert frequency of the laser beam which is reflected with phase conjugation and amplified; and a wedge-shaped glass plate which is disposed at a front side of the n-th order harmonic generator so as to change an optical path of the laser beam, wherein the optical path of the laser beam is changed in the wedge-shaped glass plate by controlling a value n of the n-th order harmonic generator and an angle β of the wedge-shaped glass plate, thereby intercepting the target.

5. The high-energy laser system of claim 4, further comprising:

a polarizing beam splitter which transmits or reflects the laser beam so as to be irradiated to the target according to whether the laser beam is P-polarized or S-polarized; and a polarization converter which is disposed at a front end of the polarizing beam splitter so as to convert an initial linearly polarized light transmitted through or reflected by the polarizing beam splitter into a circularly polarized light and also convert the laser beam reflected by the target into a laser beam which is linearly polarized perpendicular to the initial linearly polarized light, wherein the polarizing beam splitter functions to reflect or transmit the laser beam reflected by the target and passed through the polarization converter so that the laser beam is incident to the light amplifier.

6. The high-energy laser system of claim 5, further comprising:

a light irradiating device which is disposed at a front end of the high-energy laser system so as to irradiate the laser beam;

a target track sensor which measures position and speed of the target and generates a control signal in real time; and an aiming mirror which is controlled by the control signal of the target track sensor so as to aim the target, wherein the sunlight reflected from the target is collected by the light irradiating device and then incident to the target track sensor, and the target track sensor determines the position and speed of the target from the incident sunlight so as to control the aiming mirror and thus aim the target, and the laser beam generated from the laser oscillator is irradiated to the target by the aiming mirror and light irradiating device, reflected from the target and then collimated in the light irradiating device, and the collimated laser beam passing the aiming mirror is amplified and reflected with phase conjugation in the light amplifier using SBS-PCM, reflected by the aiming mirror and then passed through the light irradiating device so as to be irradiated to the target, thereby intercepting the target.

7. A method of intercepting a target with a high energy laser beam, comprising:

irradiating a laser beam from a laser oscillator to the target;

first amplification of amplifying the laser beam, reflected from the target after being irradiated to the target, in a light amplifier;

reflecting the amplified laser beam by a phase conjugate mirror;

second amplification of amplifying again the laser beam reflected by the phase conjugate mirror in the light amplifier;

irradiating the amplified laser beam with high energy to the target by using only passive components and intercepting the target;

converting a frequency of the laser beam reflected with phase conjugation using a frequency converter;

changing an optical path of the laser beam with a converted frequency using a wedge-shaped glass plate; and irradiating the laser light along the changed optical path to the moved target and intercepting the target.

8. A method of intercepting a target with a high energy laser beam, comprising:

irradiating a laser beam from a laser oscillator to the target;

amplifying and reflecting the laser beam reflected from the target after being irradiated to the target in a light amplifier using a Stimulated Brillouin Scattering Phase Conjugate Mirror (SBS-PCM); and irradiating the laser beam reflected with phase conjugation to the target by using only passive components and intercepting the target, converting a frequency of the laser beam reflected with phase conjugation using a frequency converter;

changing an optical path of the laser beam with a converted frequency shaped glass plate; and irradiating the laser light along the changed optical path to the moved target and intercepting the target.

* * * * *